US005489024A

United States Patent [19]

Bunin

[11] Patent Number: 5,489,024

[45] Date of Patent: Feb. 6, 1996

[54] CHILD RESISTANT MEDICATION CONTAINER

[75] Inventor: Leonid Bunin, Woodbridge, N.J.

[73] Assignee: Merck & Co., Inc., Rahway, N.J.

[21] Appl. No.: 287,327

[22] Filed: Aug. 8, 1994

[51] Int. Cl.[6] ..... B65D 1/09; B65D 83/04

[52] U.S. Cl. ..... 206/528; 206/530; 206/535; 206/536; 206/540

[58] Field of Search ..... 206/528, 530, 206/531, 532, 535, 536, 537, 540, 1.5; 220/281; 215/216

[56] References Cited

U.S. PATENT DOCUMENTS

| | | | |
|---|---|---|---|
| 3,762,539 | 10/1973 | Kerr | 206/537 |
| 3,889,847 | 6/1975 | Uroshevich et al. | 206/536 X |
| 4,056,209 | 10/1977 | Winkler et al. | 206/1.5 X |
| 4,106,651 | 8/1978 | Lemons | 215/216 X |
| 4,413,742 | 10/1983 | Sandhaus | 215/216 |
| 4,971,203 | 10/1990 | Weinstein | 206/536 |
| 5,082,114 | 1/1992 | Bunin | 206/539 |
| 5,141,129 | 8/1992 | Jennings | 221/154 |
| 5,163,559 | 10/1992 | Bunin | 206/532 |
| 5,178,298 | 1/1993 | Allina | 221/24 |
| 5,213,213 | 5/1993 | Bunin | 206/535 |
| 5,269,413 | 12/1993 | Stern | 206/535 |

*Primary Examiner*—Steven N. Meyers
*Assistant Examiner*—Tara L. Laster
*Attorney, Agent, or Firm*—Francis P. Bigley; Mark R. Daniel

[57] ABSTRACT

There is disclosed a medication container which is adapted to be side loaded with unit doses of medication during packaging operations. After being filled with the unit doses of medication, the container side is sealed. The medication doses can be removed by a user from the sealed container by means of a child resistant removable closure at one end of the container.

2 Claims, 2 Drawing Sheets

CHILD RESISTANT MEDICATION CONTAINER

BACKGROUND OF THE INVENTION

Unit doses of medication that are prepared in the form of tablets, capsules, caplets, and the like, are generally packaged in bottles which are typically loaded or filled into the bottle through its neck. After being thusly loaded or filled, the bottles are usually closed with a removable cap means so that a patient can access the medication.

A more convenient package form has been provided in a earlier invention, U.S. Pat. No. 5,213,213, issued May 25, 1993, which relates to a elongated container body C ("stick") having a removable closure means ("cap"). This has been found to be a convenient form to consumers, who have frequently responded to surveys requesting package designs which are in smaller sizes and which are easy to lift and carry. However, this package does not have any particular child-resistant (CR) cap associated with it.

Ironically, senior citizens who most prefer small size packages, also dislike many commonly available "child-resistant" (CR) packaging as they have difficulty in opening, or experience spills in opening. However, CR packages are widely used as mandated by government regulations, in both OTC and prescription drugs for certain classes of medications. If a senior citizen has a package which has a hard-to-open cap, once the cap is off, it stays off. From that point on, the original child-resistant container is anything but.

SUMMARY OF THE INVENTION

It has now been found that a medication container having an elongated body can be provided with a simple, yet easy-to-use (CR) cap.

In general, the medication container of the invention comprises an elongated body having a closed end and an open end and is adapted to receive and accommodate unit doses of medication of different sizes and shapes; a child resistant removable closure means to close the open end of said container; an elongated opening formed in the wall of said container, said opening being substantially parallel to the longitudinal axis of said container; and, means to cover and seal said opening after said container has been loaded with unit doses of medication.

The geometric form of the medication container is not critical but for ease of manufacture and to minimize cost, it is preferably tubular or rectangular. The means to removably close the open end of the container is a critical feature of this invention, and is a cylindrical cap having a cam-like projection which is engaged by a spring element separate from the body of the container. This spring element can be depressed by exerting pressure on the cover across the elongated opening in the wall of the container, thereby disengaging the cam from the spring, so that the cap opens. The pressure required to push on the cover is relatively slight, much less than that of the commonly employed "push & twist" (CR) caps, yet has been demonstrated child resistant using a standard effectiveness study protocol.

The material used to cover and seal the elongated opening after the container has been loaded or filled with the unit doses of medication is not critical, but it should be such that once sealed to the container body over the elongated opening it is difficult to remove, yet flexible. Conventional materials such as plastic films or aluminum foilplastic laminates, and the like, can be employed for this purpose.

Although the medication container of the invention can be made from any suitable material, moldable plastics such as high or low density polyethylene, polypropylene, and the like, are preferred as they are readily moldable and economic.

DETAILED DESCRIPTION OF THE INVENTION

The medication container of the invention will become more apparent from the ensuing description when considered together with the accompanying drawing wherein.

Figure 1:
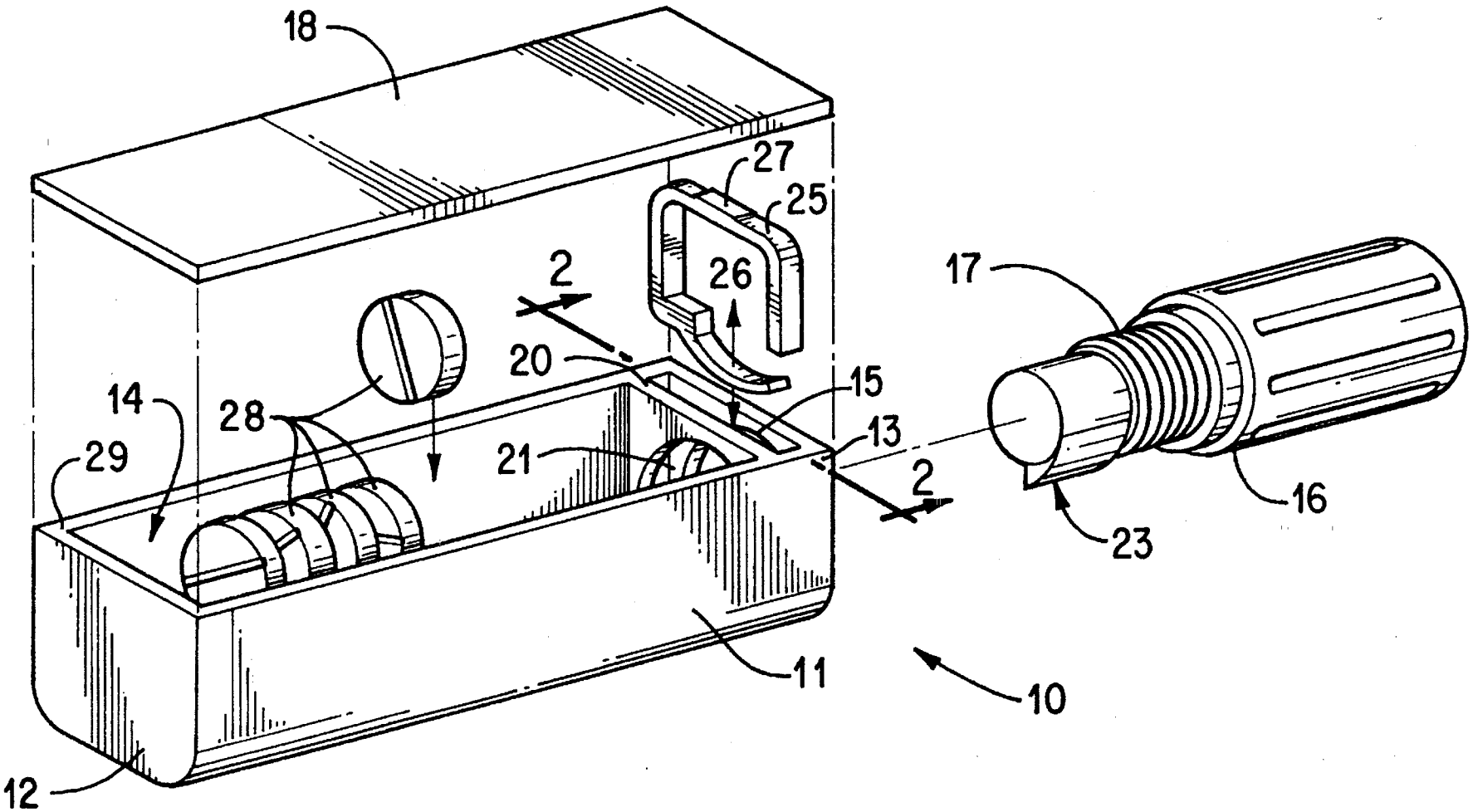
FIG. 1 is a perspective view of the medication container of the invention.
Figure 2:
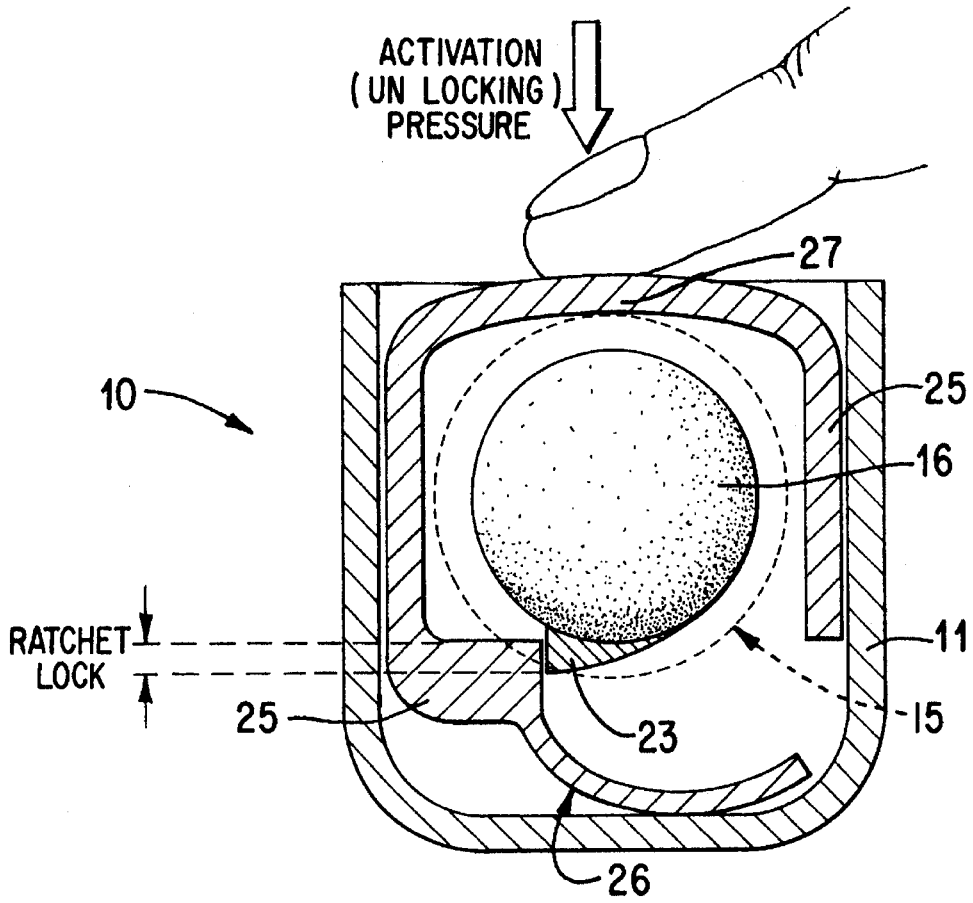
FIG. 2 is a cross-section view of the container shown in FIG. 1; taken along line A—A; and, FIG. 3 is a perspective view of the method of opening the container.
Figure 3:
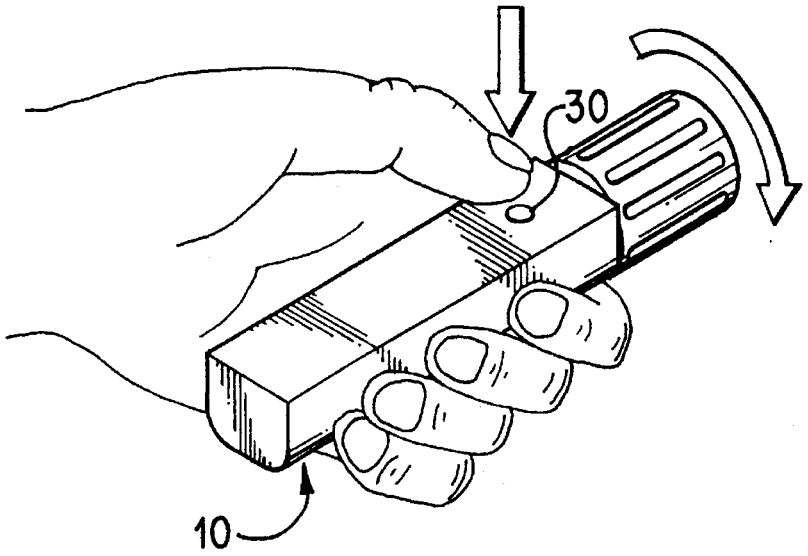

Turning now to the drawing, wherein like reference numerals denote like parts, there is shown in FIGS. 1–3 the medication container of the invention generally identified by reference numeral 10. The body 11 of container 10 has a closed end 12, and an opposed open end 13 and an minor wall 20 paralleled to open end 13. An elongated opening 14 is formed in the wall of the body 11 which is substantially parallel to the longitudinal axis of body 11. In the embodiment illustrated, open end 13 carries internal threads 15 to receive a removable cap 16 having external threads 17 and an inner cap extension 22 provided with an eccentric cam-shaped protrusion 23. Inner wall 20 has round opening 21 through which the inner cap extension 22 fits. A cover means 18 is employed to overlay the elongated opening 14 and is sealed to the body 11 of container 10 in the area defining the periphery of elongated opening 14.

Fitted in between inner wall 20 and open end 13 is a ratchet block part 25 (shown above and outside the container) which engages cap 16 when the cap 16 having external threads 17 is screwed onto internal threads 15. This ratchet block part 25 is made from Delrin or a moldable plastic with elastic, or spring-like properties. The eccentric cam-shaped protrusion 23 on the inner cap extension 22 engaged the bottom flanges or spring element 26 of ratchet block part 25. The top 27 of the ratchet block part 25 must be pushed through lid 18 in order to disengage the cam-shaped protrusion 23 from spring element 26 when unscrewing cap 16 to open the container 10.

The action of unlocking is further illustrated in the cross section of FIG. 2. Showing container 10. Ratchet block part 25 with the top 27 and spring element 26 is being depressed to disengage the eccentric cam-shaped protrusion 23 on inner cap extension 22, so that the cap can be removed. Shown in the dotted line is the internl thread I.D. 15 through which the tablets pass.

FIG. 3 illustrates the action of opening container 10, in which dot 30 indicates the point at which pressure is exerted to activate or unlock the spring element.

Prior to filling and loading medication container 10, removable cap 16 is threadably screwed through ratchet block part 25 and open end 13 so that both ends of container 10 are closed during the filling and loading operation. During automated filling and loading operation, container 10 is conveyed to one or more filling and loading stations by such means as conventional conveyor belts. At the filling and loading stations, a pre-determined number of unit doses of medication, here shown in the form of tablets 28, are all deposited concurrently into container 10; i.e., in a single one-drop operation. Once the container 10 has been loaded with the medication, it is conveyed to a station where cover means 18 is placed to overlay elongated opening 14. Cover means 18 can then be sealably secured to the top wall 29 such as by heat sealing at the same station or be conveyed to another station to be sealably secured. This operation also secures ratchet block part 25 so that it does not fall out when the cap 16 is opened.

To access the medication in the container 10, a patient would unscrew and remove cap 16 as shown in FIG. 3 and remove that quantity of unit dose medication needed. When closing, the cap engages the ratchet with an audible click to assure child safety. The cap can be made from a slightly harder material than the container, so that it serves as a self-gasket when tightly closed, and bites into the container, or vice versa. In a preferred application, Delrin or polypropylene can be used for the cap, and LDPE for the container.

Thus, the medication container of the invention provides several significant advantages over conventional bottles currently used. Primarily, it provides a child resistant cap or a medication container which permits loading of the entire predetermined number of medication units as a one load drop as opposed to loading bottles through their necks with individual medication units. No additional packing is required at the dispensing end of the medication container of the invention whereas bottles generally require some type of packing such as cotton to fill in empty head space. The relatively narrow opening at the dispensing end of the medication container of the invention permits a user to readily extract individual medication units separately as opposed to shaking out an individual medication unit from the conventional, wide mouth opening of bottles thereby making it more convenient for a user and minimizing contamination of the medication units that may be caused by frequent user handling.

While the medication container of the invention has been described in some detail and with particularity, it will be appreciated by those skilled in the art that changes and modifications can be made therein without departing from the scope of the invention defined in the claims.

What is claimed is:

1. A medication container comprising:

(a) an elongated container body having a closed end and an open end, said container body adapted to receive and accommodate unit doses of medication having different sizes and shapes;

(b) a ratchet block part having a ratchet block part top and a bottom spring element; a removable closure means to close said open end, said removable closure means having an extemally threaded cap member adapted to be threadably screwed into internal threads formed in said open end; and inner cap extension having an eccentric cam shaped protrusion; said eccentric cam shaped protrusion being disengagably secured into the bottom spring element of the ratchet block part;

(c) an elongated opening formed in the wall of said container body, said opening being substantially parallel to the longitudinal axis of said container body; and, (d) cover means to overlay said elongated opening and seal said container.

2. The medication container of claim 1 in which the eccentric cam-shaped protrusion and the inner cap extension is disengaged from its secured position by manual pressure on the cover means of the container on the top of the ratchet block part.

* * * * *

UNITED STATES PATENT AND TRADEMARK OFFICE

CERTIFICATE OF CORRECTION

PATENT NO. : 5,489,024
DATED : February 6, 1996
INVENTOR(S) : Leonid Bunin

It is certified that error appears in the above-indentified patent and that said Letters Patent is hereby corrected as shown below:

In claim 1, column 4, line 19, after the word "end;" please replace the word "and" with the word --an--.

Signed and Sealed this

Sixth Day of August, 1996

*Attest:*

Bruce Lehman

BRUCE LEHMAN

*Attesting Officer*

*Commissioner of Patents and Trademarks*